US008350775B2

(12) United States Patent
Obermaier et al.

(10) Patent No.: US 8,350,775 B2
(45) Date of Patent: Jan. 8, 2013

(54) ANTENNA ARRANGEMENT FOR A MOBILE RADIO BASE STATION

(75) Inventors: Johann Obermaier, Weiching (DE); Matthias Riedel, Stephanskirchen (DE); Stephen John Saddington, Vogtareuth (DE)

(73) Assignee: Kathrein-Werke KG, Rosenheim (DE)

( * ) Notice: Subject to any disclaimer, the term of this patent is extended or adjusted under 35 U.S.C. 154(b) by 524 days.

(21) Appl. No.: 12/376,615

(22) PCT Filed: Jul. 26, 2007

(86) PCT No.: PCT/EP2007/006638

§ 371 (c)(1),
(2), (4) Date: Feb. 6, 2009

(87) PCT Pub. No.: WO2008/017386

PCT Pub. Date: Feb. 14, 2008

(65) Prior Publication Data

US 2010/0182213 A1 Jul. 22, 2010

(30) Foreign Application Priority Data

Aug. 10, 2006 (DE) ..... 102006037518

(51) Int. Cl.
*H01Q 9/16* (2006.01)
*H01Q 21/00* (2006.01)
*H01Q 19/10* (2006.01)

(52) U.S. Cl. ..... 343/817; 343/797; 343/834; 343/795; 343/847; 343/818

(58) Field of Classification Search ..... 343/810–823, 343/847, 834, 795, 846
See application file for complete search history.

(56) References Cited

U.S. PATENT DOCUMENTS

| | | | | |
|---|---|---|---|---|
| 5,239,793 | A * | 8/1993 | Chiappetta et al. | 52/108 |
| 5,710,569 | A | 1/1998 | Oh et al. | |
| 5,909,195 | A * | 6/1999 | Merenda | 343/815 |
| 6,008,763 | A | 12/1999 | Nystrom et al. | |
| 6,885,352 | B2 * | 4/2005 | Lee et al. | 343/836 |
| 2004/0201537 | A1 * | 10/2004 | Stolle et al. | 343/797 |
| 2005/0001778 | A1 * | 1/2005 | Le et al. | 343/810 |
| 2005/0237258 | A1 | 10/2005 | Abramov et al. | |

FOREIGN PATENT DOCUMENTS

DE 196 27 015 1/1998

(Continued)

OTHER PUBLICATIONS

International Search Report for PCT/EP2007/006638, mailed Nov. 7, 2007.

(Continued)

*Primary Examiner* — Hoang V Nguyen
*Assistant Examiner* — Amal Patel
(74) *Attorney, Agent, or Firm* — Nixon & Vanderhye P.C.

(57) ABSTRACT

An improved antenna arrangement includes a reflector arrangement comprising a printed circuit board with an electrically conductive ground plane. The reflector arrangement also has a reflector frame with a coupling surface. The coupling surface is capacitively coupled to the ground plane. The coupling surface has a recess via which the ground plane, which is located underneath it, and/or the printed circuit board or an isolating intermediate layer which is provided above the ground plane or an isolating intermediate layer which is provided above the printed circuit board is exposed. The at least one antenna element arrangement is positioned and/or held on the printed circuit board in the area of the recess.

28 Claims, 8 Drawing Sheets

FOREIGN PATENT DOCUMENTS

| | | |
|---|---|---|
| DE | 197 22 742 | 12/1998 |
| DE | 101 50 150 | 5/2003 |
| DE | 697 25 874 | 8/2004 |
| DE | 103 59 622 | 7/2005 |
| EP | 0 916 169 | 8/2002 |
| EP | 1 588 454 | 6/2006 |
| WO | WO 99/62138 | 12/1999 |
| WO | WO 00/39894 | 7/2000 |
| WO | WO 01/41256 | 6/2001 |
| WO | WO 0141256 A1 * | 6/2001 |
| WO | WO 2005/060049 | 6/2005 |
| WO | WO 2006059937 A1 * | 6/2006 |

OTHER PUBLICATIONS

German-language International Preliminary Report on Patentability for PCT/EP2007/006638, dated Jul. 30, 2008, including 12 Amended Sheets.

* cited by examiner

ANTENNA ARRANGEMENT FOR A MOBILE RADIO BASE STATION

This application is the U.S. national phase of International Application No. PCT/EP2007/006638, filed 26 Jul. 2007, which designated the U.S. and claims priority to German Application No. 102006037518.1, filed 10 Aug. 2006, the entire contents of each of which are hereby incorporated by reference.

FIELD

The invention relates to an antenna arrangement, in particular for a mobile radio base station.

BACKGROUND AND SUMMARY

An antenna arrangement of this kind is known from EP 1 588 454 B1. This anticipatory document describes the use of, for example, an antenna arrangement, which can be vertically oriented, having a reflector. On the vertical lateral limiting lines of the reflectors two lateral webs are formed transversely, and in particular perpendicularly, to the reflector plane so as to protrude in the direction of radiation. The dual-polarized radiators arranged one above the other in the vertical direction sit between these lateral webs. According to this anticipatory document also, the base of the supporting mechanism and/or balancing means of the associated radiator assembly is capacitively connected (i.e. without electrical-galvanic contact) to the reflector or coupled thereto by connecting a cap in series. For this purpose, the reflector has a recess in which the non-conductive cap engages and is secured and in turn holds the supporting mechanism and/or balancing means or the base of the supporting mechanism and/or balancing means of the dual-polarized radiator. The internal conductor can be installed as is described in the above-mentioned prior art in this case. A flat antenna is known from DE 697 25 874 T2. It comprises a ground plane layer that is capacitively coupled to a base unit. A dielectric layer is provided between these two layers.

Antenna arrangements, in particular for a mobile radio base station, are also known for example from WO 00/039894 A1. This anticipatory document describes a reflector that can be vertical oriented. On the two vertical and mutually parallel outer, laterally located limits of the reflector, a lateral web is formed that protrudes in the direction of radiation and therefore transversely to the reflector plane. A plurality of dipolar arrangements consist of what are known as vector dipoles. They are provided radiating in two mutually perpendicularly oriented polarization planes one above the other in the vertical direction. In terms of construction, these vector dipoles are similar to dipole squares. Nevertheless, feeding takes place in such a way that despite the horizontally or vertically oriented dipoles, overall the dipole arrangement acts as an X-polarized antenna in which the two polarization planes that are perpendicular to each other are oriented at an angle of +45° or −45° with respect to the vertical or horizontal.

It can be gathered from WO 2005/060049 A1 that the dual-polarized radiators, which sit upstream of a reflector, may be provided with a capacitive outer conductor coupling. Axial holes that run perpendicular to the reflector plane are therefore introduced in each half of the two supporting mechanisms and/or balancing means that are rotated by 90° with respect to each other. Rod-shaped coupling elements 21 that are galvanically connected to the reflector project into these holes and are surrounded by cylindrical insulators onto which the pairs of supporting halves of the dual-polarized radiator assembly that are arranged rotated by 90° with respect to each other can be placed with the total of four axial holes. An internal conductor for feeding the two mutually perpendicular polarizations of the radiator assembly can be laid inside two rod-shaped coupling elements from the back of the reflector in each case.

Finally, antenna arrangements with reflectors are known on the longitudinal lateral regions of which, i.e. on the longitudinal or vertical lateral surfaces of which, longitudinal webs that protrude forwards from the reflector plane are provided, as may be gathered for example from the anticipatory documents WO 99/62138 A1, U.S. Pat. No. 5,710,569 A or EP 0 916 169 B1.

An alternative embodiment according to this anticipatory document discloses that instead of an electrically conductive reflector, conventionally in the form of a metal sheet, a printed circuit board may also be used on which the reflector is constructed. In this case, the electrically conductive ground plane is preferably omitted on one side of the printed circuit board or the cap is also provided with insulation in this region.

Finally, reference is made to WO 01/41256 A1 which describes a patch antenna. This patch antenna is arranged on a dielectric printed circuit board, which is provided with an electrically conductive layer on both sides. On the conductive dimension in the beam direction, a cross-shaped recess is provided, above which a radiator patch is arranged.

By contrast, the illustrative technology herein creates an improved dipolar shaped antenna arrangement which includes beam shaping possibilities and still has a simple construction.

The invention creates an improved antenna arrangement that can be easily and highly accurately produced with exactly predetermined radiation properties while avoiding potential sources of disruption such as undesirable intermodulations.

It has previously been conventional in the prior art to usually use reflectors made from a metal sheet. The radiator modules have been constructed on the reflectors. The longitudinal lateral limits have been in the form of longitudinal webs. These webs protrude transversely to the reflector plane. The webs can be constructed at a suitable location based on arranging the radiators between the reflector plane lateral external limit and the centrally arranged radiators. These longitudinal webs could be adjusted for example between a perpendicular orientation with respect to the reflector plane through to an angular orientation in such a way that desired beam shaping was possible.

If, by contrast, one wanted to use reflectors in the form of printed circuit boards (what are referred to as PCBs) which were provided on one side with an electrically conductive ground plane, then this required the webs needed for beam shaping to be connected to the ground plane of the printed circuit board by means of screw connections or soldered joints in order to achieve a definite galvanic connection at that point. In addition to being laborious, this assembly work caused potential intermodulation sources or disruption.

By contrast it is now proposed, starting from a printed circuit board which is preferably provided on its radiator side with an electrically conductive ground plane and a insulating layer located above it, to place a reflector frame thereon. The reflector plane is provided with a coupling surface parallel to the ground plane of the printed circuit board. The desired longitudinal and/or transverse webs that are required for diagram shaping in turn are constructed on this coupling surface. In other words, a capacitive reflector frame coupling is proposed, for a dipolar shaped radiator assembly (preferably a dual-polarized radiator assembly), that allows the longitudinal and/or transverse webs required for diagram shaping to be capacitively coupled to a ground plane sitting on a printed circuit board.

In a preferred embodiment, the reflector frame provided according to the invention can be made from an electrically conductive metal, for example aluminum. In particular, a reflector frame of this kind can be produced by way of all suitable production processes, for example by a casting process, by shaping, milling, etc. It is also possible to produce a reflector frame of this kind from an electrically non-conductive material, for example plastics material, which is coated with an electrically conductive layer.

In a particularly preferred embodiment, the reflector frame is produced from a punching, in particular from a metal sheet, by means of a punching/bending process. In the process it is possible by way of suitable punching and subsequent canting to produce an appropriate three-dimensionally shaped reflector frame from a metal sheet in which the lateral limits or webs are assembled from the metal sheet plane by canting and orientation transverse to the reflector plane. At the same time, mutually offset transverse webs can be provided in the add-on direction, whereby the individual radiators or radiator groups are delimited from each other. These transverse webs can also be assembled transversely, and in particular perpendicularly, to the reflector plane by punching and canting or bending.

In a particularly preferred embodiment tongues are formed on the outside of the thus formed transverse webs so as to project away from each other in the axial extension. The tongues can engage in corresponding slotted recesses in the longitudinal lateral limitations if the longitudinal lateral limit has also been assembled in corresponding transverse orientation to the reflector plane following the punching and canting process.

Capacitive coupling of the reflector frame on a printed circuit board without galvanic connection between reflector and printed circuit board ground plane is therefore provided. A stable intermodulation-free connection is provided. A clearly defined spacing and/or a clearly definable size of the coupling surfaces means that an exactly defined coupling between ground plane of the printed circuit board and the reflector frame may also primarily be ensured.

Finally quick and uncomplicated assembly is also possible, whereby sources of error are reduced and above all soldered joints are omitted on the reflector.

The completely assembled unit, comprising reflector frame and printed circuit board, forms a self-supporting unit. The reflector frame can be connected to the printed circuit board using any suitable means, for example by means of clips, a double-sided adhesive tape, separate adhesives, etc.

The ground plane on the printed circuit board is preferably originally provided with an insulating layer, for example in the form of paint, in particular a solder resist, a film or some other plastics material layer, which allows metallic isolation from the reflector frame. If the reflector frame is glued by means of a double-sided adhesive tape then this already provides an insulation and therewith metallic isolation between the electrically conductive reflector frame on the one hand and the ground frame on the printed circuit board on the other, so a separate insulating layer can even be omitted on the ground plane.

BRIEF DESCRIPTION OF THE DRAWINGS

Further advantages, details and features emerge from the following embodiments described with reference to figures, in which, in detail.

DETAILED DESCRIPTION

Figure 1:
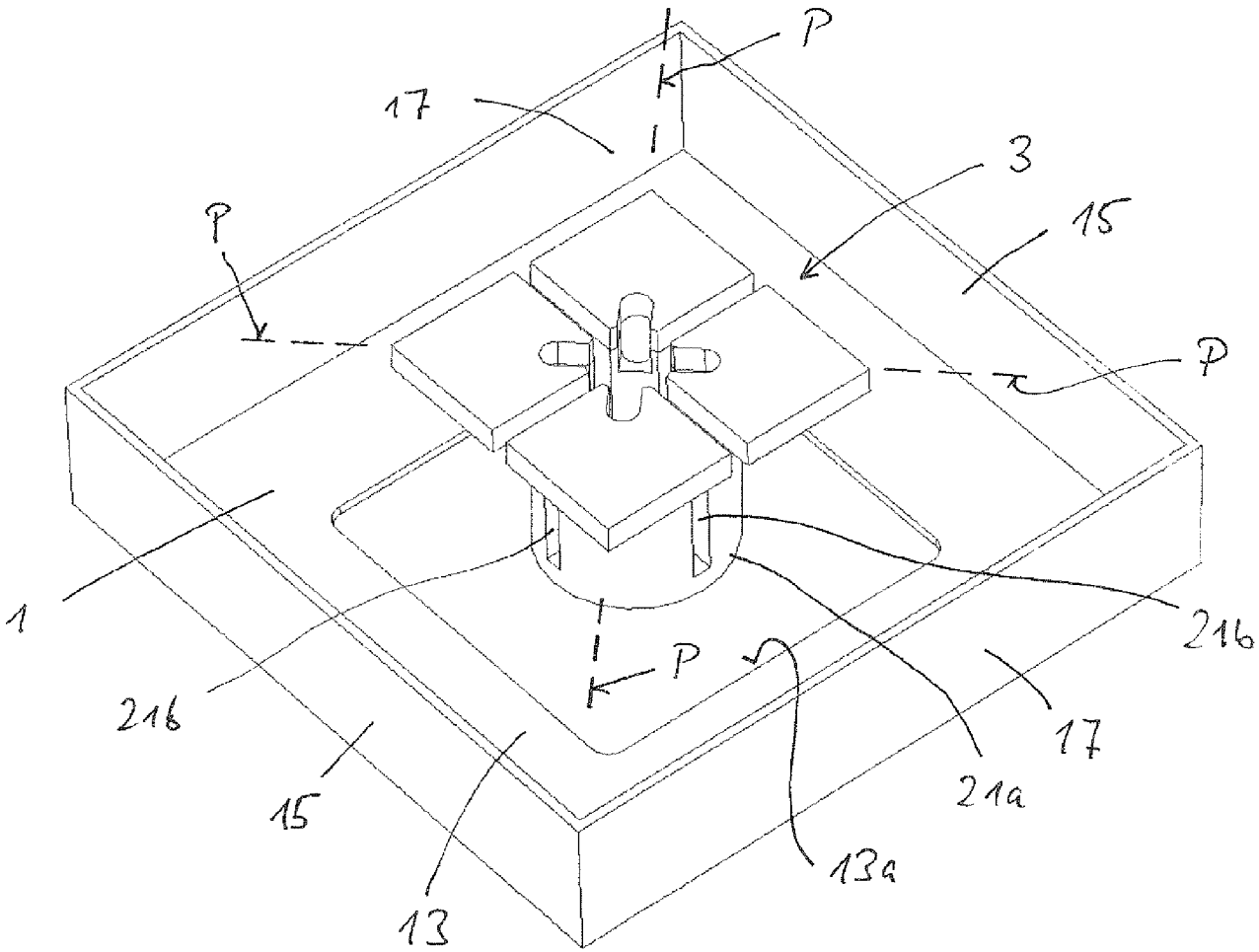
FIG. 1 shows a schematic three-dimensional illustration of a basic type of inventive antenna with a dual-polarized radiator assembly.

FIG. 1 shows the basic type of inventive antenna arrangement as can be used for example for a mobile radio base station. The antenna arrangement comprises a reflector arrangement 1, upstream of which a dual-polarized radiator or a dual-polarized radiator assembly 3 is provided. The illustrated embodiment involves a vector dipole which radiates in two mutually perpendicular polarization planes P that are perpendicular to the reflector plane and run more or less diagonally through the corners of the, in plan view, quadratically shaped radiator assembly. Reference is made by way of example to WO 00/039894 A1 with respect to the construction and mode of operation of a radiator of this type.

Basically however any radiator or radiator type can be used within the scope of the invention, in particular dipole radiators and/or patch radiators, as are known for example from anticipatory documents DE 197 22 742 A1, DE 196 27 015 A1, U.S. Pat. No. 5,710,569 A, WO 00/039894 A1 or DE 101 50 150 A1.

Figure 2:
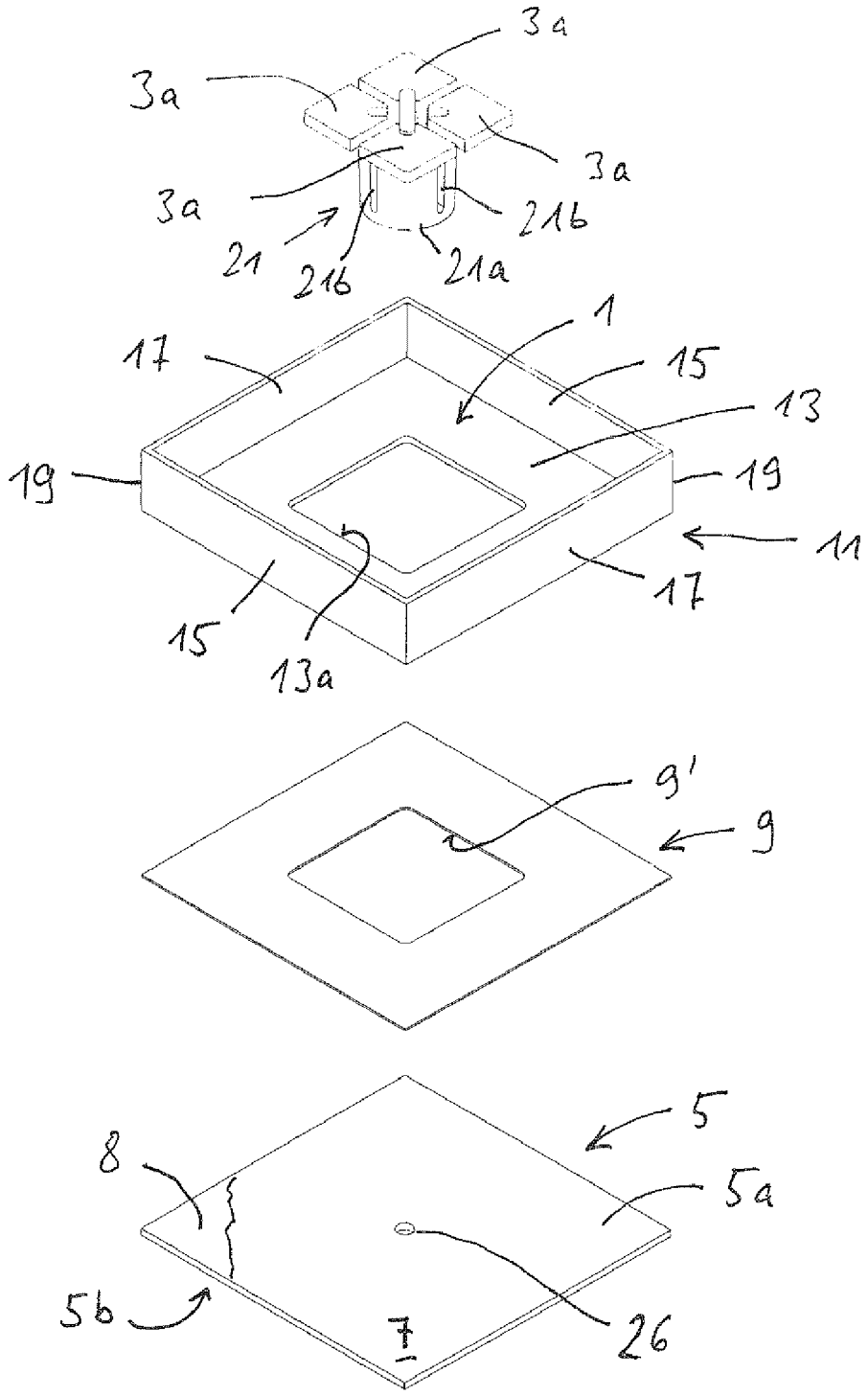
FIG. 2 shows an exploded view of the embodiment of FIG. 1.

The dual-polarized radiator shown in FIGS. 1 and 2 each comprise two pairs of radiator halves 3*a* that are mutually offset by 90° and are each held by a supporting mechanism and/or balancing means 21 located underneath. In terms of principle the supporting mechanism and/or balancing means 21 is two supporting mechanisms and/or balancing means that are mutually offset by 90° (namely for each polarization), for which purpose downwardly extending slots 21*b* that separate the radiator halves 3*a* from each other are provided in the supporting mechanism 21 (the balancing means being part of this supporting mechanism). The slots end just before the base 21*a* located underneath which connects everything together.

As also emerges in particular from the exploded view in FIG. 2, the overall construction of the antenna arrangement is such that it comprises a printed circuit board 5, namely what is referred to as a PCB, which is preferably provided on the side 5*a* that faces the radiator side, what is known as the radiator or ground plane side 5*a*, with a preferably all-over electrically conductive ground plane 7. The electrical components and the strip conductors that connect the electrical components are then provided on the opposing strip conductor plane 5*b* (i.e. on the underside of the printed circuit board 5 that is not shown in detail in FIGS. 1 and 2).

The ground plane 7 is conventionally covered with an insulating layer 8, which is indicated in FIG. 2 only in the left-hand region, for example in the form of a plastics material or film layer, a paint layer, for example in the form of what is known as a solder resist layer, etc.

Building thereon an arrangement 11 that is separately reproduced in FIG. 2 is disclosed which will hereinafter also be called the reflector frame 11. This reflector frame 11 comprises a coupling surface 13 which when finally assembled runs parallel to the ground plane 7. In the illustrated embodiment this coupling surface 13 is provided with longitudinal webs 15 and transverse webs 17 running perpendicular to the coupling surface 13. In the illustrated embodiment these are formed and/or provided on the external limits of the reflector frame 11. They may also be located offset and further in on the outer limits of the reflector frame 11, so a portion of the reflector that protrudes externally over the webs 15, 17 remains. These longitudinal and transverse webs 15, 17 are also connected to each other at the corner regions 19. The illustrated longitudinal or transverse webs do not have to be oriented perpendicular to the reflector surface 13. These webs can to some extent also run in an orientation to the reflector surface that differs by an angle of 90°, for example so as to diverge or converge in the beam direction or can be inclined more to the left or right, etc. In principle there are no limitations in this respect.

The reflector frame 11 is preferably an electrically conductive material, for example a metal cast part (aluminum, although other materials can also be considered here). This can also be a plastics part which is then metalized, i.e. has been coated with a metallically conductive surface. In particular when producing the reflector frame 11 from metal other production processes may be considered, for example production of the reflector frame by deep-drawing, milling or the like.

From the illustration according to FIGS. 1 and 2 it may also be seen that the coupling surface 13 is provided with a recess 13*a* which in the illustrated embodiment is so large in the longitudinal and transverse directions that the dual-polarized radiator 3 shown in FIGS. 1 and 2 also passes through this recess 13*a* with its radiator elements 3*a*.

To assemble the antenna arrangement the radiator assembly 3 is, for example, firstly mounted on the printed circuit board 5, i.e. in particular mechanically fixed. For example, this can be done by fixing a screw that is to be screwed in from the back of the printed circuit board, or by other clip-like fastening elements. The supporting mechanism and/or balancing means 21, via which the radiator elements 3*a* of the dual-polarized radiator 3 are held, are capacitively coupled to the ground plane 7 of the printed circuit board 5 located underneath. The reflector frame 11 can also be connected to the printed circuit board for example by the above-described or other suitable mechanical measures.

The printed circuit board 5, i.e. the ground plane 7 provided thereon, is covered by means of an insulating layer 8 (for example in the form of a paint layer). A capacitive coupling is produced between the underside of the supporting mechanism and/or balancing means 21 (i.e. between the electrically conductive base 21*a* of the radiator assembly 3 and the ground plane 7) and between the electrically conductive coupling surface 13 and the ground plane 7. A d.c. or galvanic connection of these parts is reliably avoided. In other words, the paint layer applied to the ground plane would be completely adequate as an insulator, so an additional insulating layer is not necessary to achieve the capacitive coupling.

However the reflector frame 11 is preferably fastened to the top of the printed circuit board 5 by means of double-sided adhesive film 9. The adhesive film 9 is provided with a window-like cut-out 9', the size and positioning of which matches or approximates the cut-out 13*a* in the coupling surface 13 of the reflector frame 11. As the insulating layer 8 is conventionally always provided on the ground plane 7 in the form of a paint layer, this insulating layer is primarily used as corrosion protection for the ground plane which is often made of copper. The double-sided adhesive film can be glued to this insulating or paint layer 8. In such a case the ground plane 7 need also not be provided with an insulating layer 8.

The adhesive tape 9 can comprise said recess 9'. It is irrelevant for the electrical functions whether the radiator device in the form of what is referred to as a vector dipole is also likewise held by means of said adhesive tape 9 with respect to the ground plane 7 or printed circuit board 5. The dipole is capacitively coupled (in this case via the lower base 21*a*) to the ground plane 7 employing the same principles as in relation to the reflector frame 11, so the spacing may also vary to a certain extent (for example 0.5 mm). This being the case, the adhesive film 9 could also be formed so as to be continuous and without window 9'. This would have certain drawbacks in terms of internal conductor assembly for the radiator assembly 3. For example, the internal conductor which is to be laid in the radiator device would have to be inserted through the adhesive tape 9. This being the case, the window-like recess 9' is preferably provided in the adhesive tape 9. In the process, the radiator is mounted on the printed circuit board by separate fixing measures while maintaining the capacitive coupling.

If the insulating layer 8 on the ground plane 7 should also be provided with a window, the insulating layer 8 is omitted in the region of this window (it being possible for this region, where the insulating layer 8 is omitted on the ground plane, to comparably match the size and/or arrangement of the other window 9' with respect to the double-sided adhesive device 9 and/or recess 13*a* in the coupling surface 13). The ground plane 7 would be "blank" in this region. In this case the base 21*a*, i.e. the underside of the supporting mechanism and/or balancing means 21, could also be galvanically connected to the ground plane 7. Holes are formed in the printed circuit board and axial holes that align therewith are formed in the base 21*a* of the supporting mechanism and/or balancing means 21 of the radiator assemblies in order to upwardly guide a respective internal conductor. The respective internal conductor is used for feeding, from the back of the printed circuit board and to galvanically couple, or inductively couple, as described for example in WO 2005/060049. This can be done via a section of a bridge to the respective diagonally opposite second half 3*a* of the radiator device 3 located above. This being the case, reference is also made in this regard to the above anticipatory document with respect to the mode of operation.

Following the thus effected pre-assembly, the reflector frame 11 is then positioned from above, the radiator assembly 3 then being guided through the recess 13*a* in the coupling surface 13 and through the recess 9' in the double-sided adhesive device 9.

Any conceivable connecting methods may be considered to ensure a secure connection between the coupling surface 13, i.e. a secure connection between the reflector frame 11 and the printed circuit board. Thus for example glue can be applied to the top of the printed circuit board (i.e. the ground plane or the insulating layer 8 that covers the ground plane) and/or to the underside of the coupling surface 13. However clip-like parts that mesh when positioned and produce a latching are also possible.

The above-mentioned double-sided adhesive tape 9 is preferably used however, whereby a strictly predefined spacing between the coupling surface 13 and the ground plane 7 is ensured and a mechanically secure connection is produced at the same time. As a result of this type of connection the reflector frame 11 with the printed circuit board 5 constitutes a securely connected, self-supporting unit.

A capacitive coupling is ensured thereby which also ensures the desired capacitive connection of the ground plane for the longitudinal and/or transverse webs 15, 17.

If the longitudinal and transverse webs 15, 17 are not securely connected to each other in their corner regions 19, they can be bent toward or away from one another by different bending, in particular if the reflector frame is made from a metal sheet, whereby the radiation diagram of the antenna can be changed and/or adjusted to the desired extent.

Figure 3:
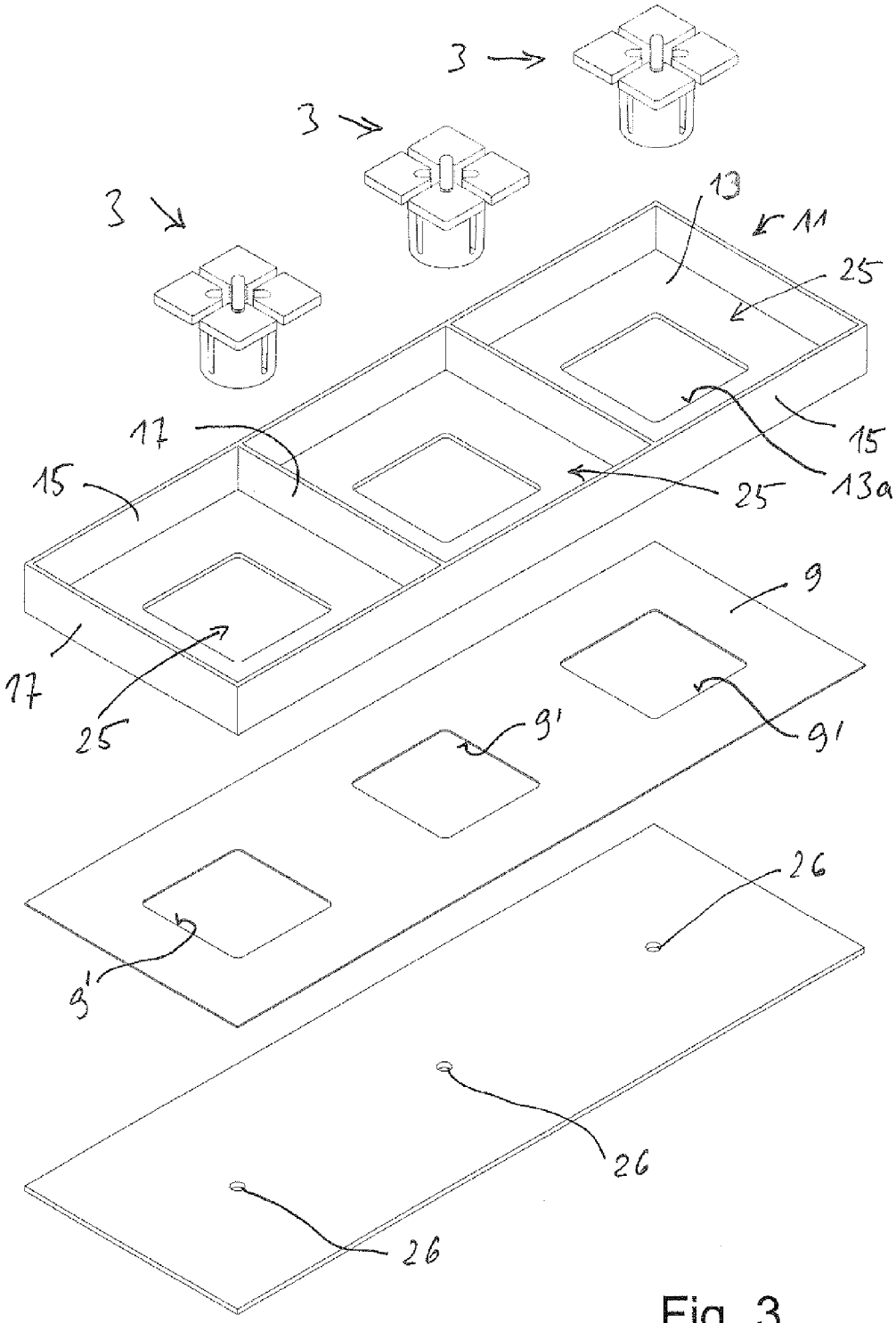
FIG. 3 shows a corresponding exploded view for an inventive antenna arrangement with three mutually offset and dual-polarized radiators.

FIG. 3 only reproduces an enlargement to the extent that the corresponding antenna arrangement can also comprise a plurality of radiator assemblies 3 that sit side by side or one above the other in the add-on direction. An antenna arrangement of this kind with a plurality of radiators is conventionally assembled in the vertical direction, so the plurality of radiator assemblies are arranged so as to be spaced apart one above the other in a vertical plane. The reflector frame can comprise a number of reflector fields 25 that matches the number of radiator arrangements. The size of the antenna arrangement can be enlarged as desired in this respect. In this case the double-sided adhesive tape 9 is preferably formed as a correspondingly elongated film which is provided with three recesses 9' that match the three recesses or windows 13*a* in three thus formed reflector fields 25 of the reflector frame 11. The hole 26 worked into the printed circuit boards means that, similar to in the embodiment according to FIG. 3, the respective radiator device can be fixed from below by screwing a screw into the base 21*a* of the supporting mechanism and/or balancing means 21 of the radiator device 13. An electrically non-conductive screw is preferably used. The base of the supporting mechanism and/or balancing means of the radiator device 3 is thus capacitively coupled to the ground plane 7 of the printed circuit board 5.

Figure 4:
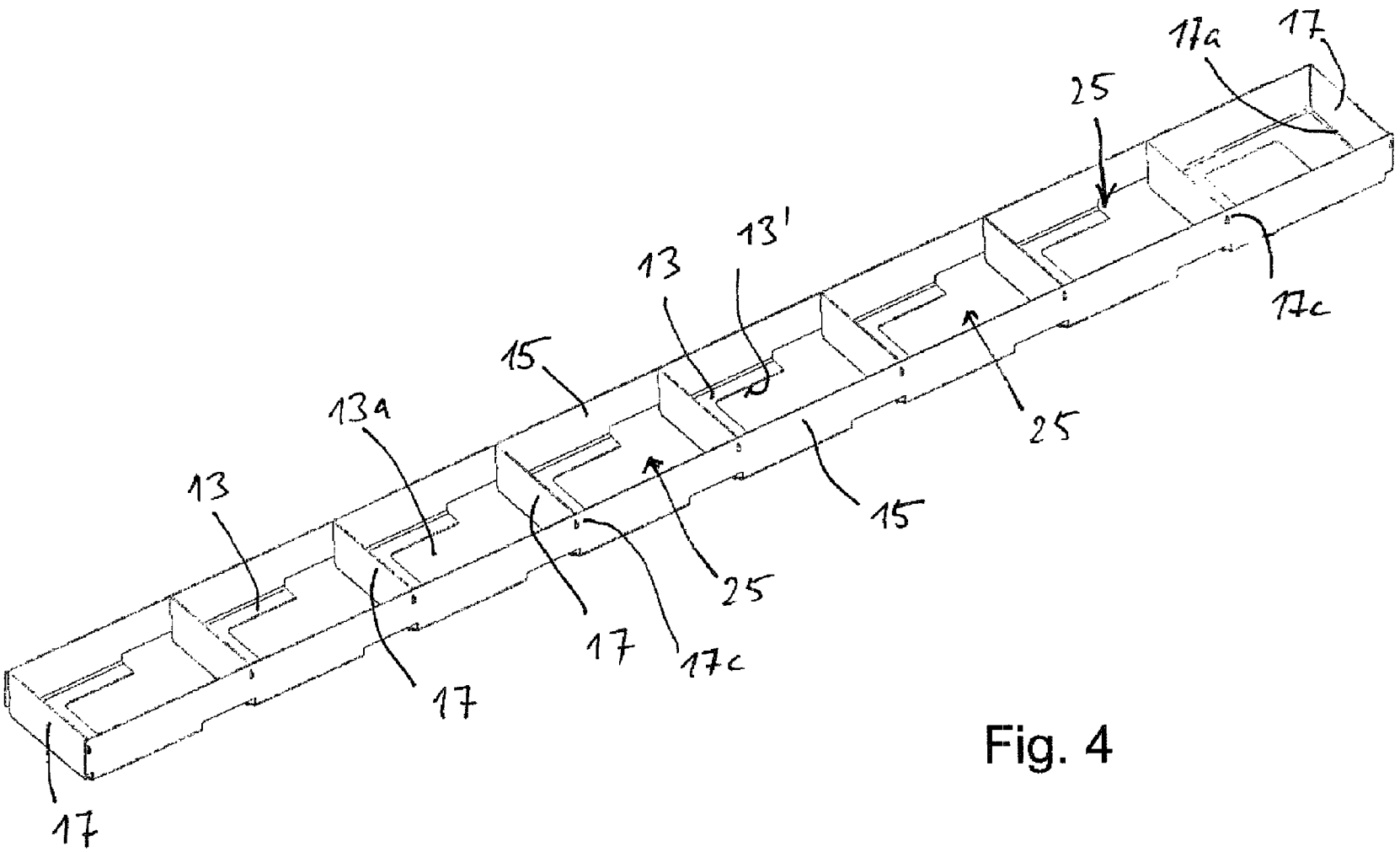
FIG. 4 shows a further embodiment of an inventive reflector frame for, by way of example, eight radiator devices arranged mutually offset in the add-on direction.
Figure 5:
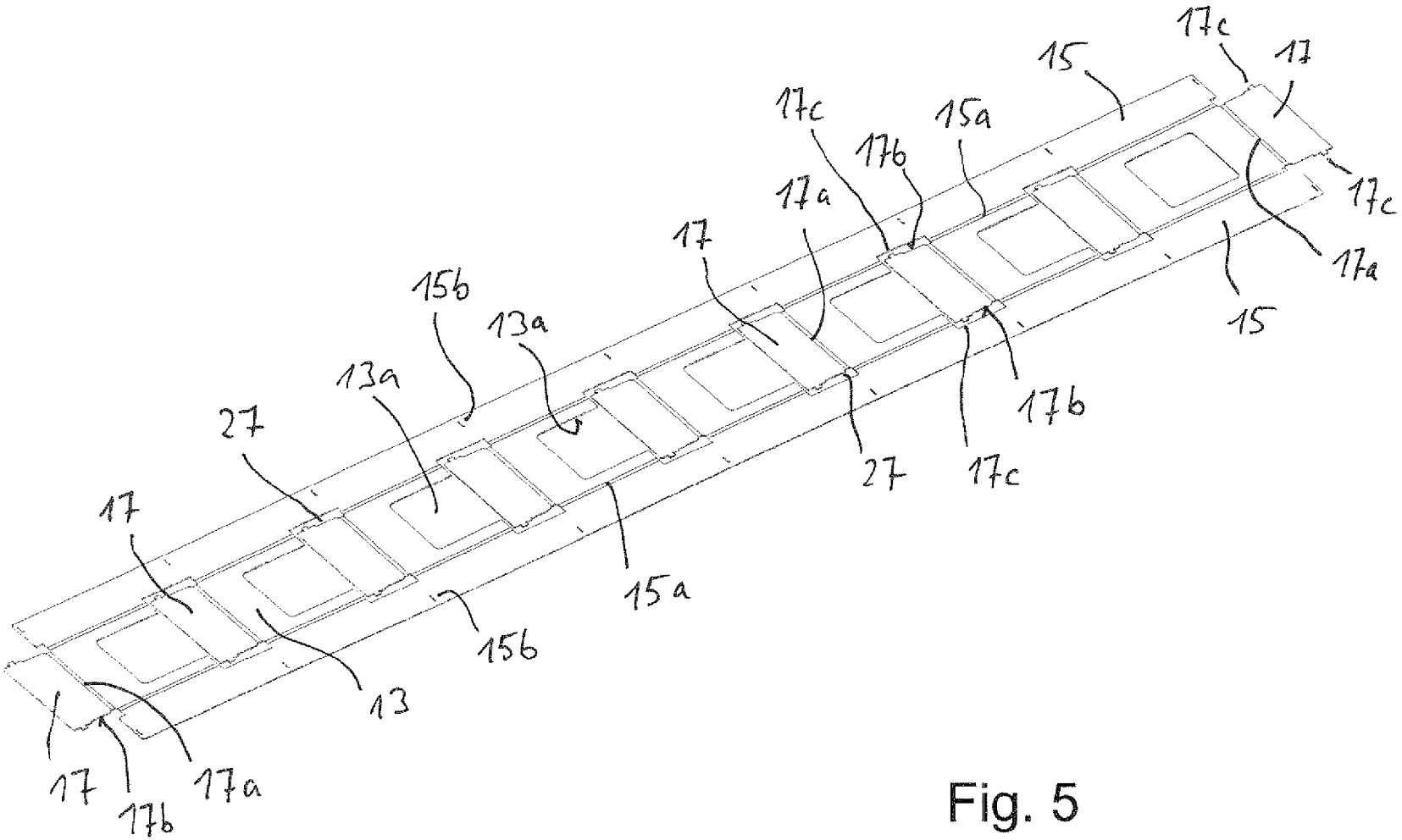
FIG. 5 shows a metal sheet as the starting point for forming a reflector frame, disclosed with reference to FIG. 4, by illustrating the punching lines.
Figure 6:
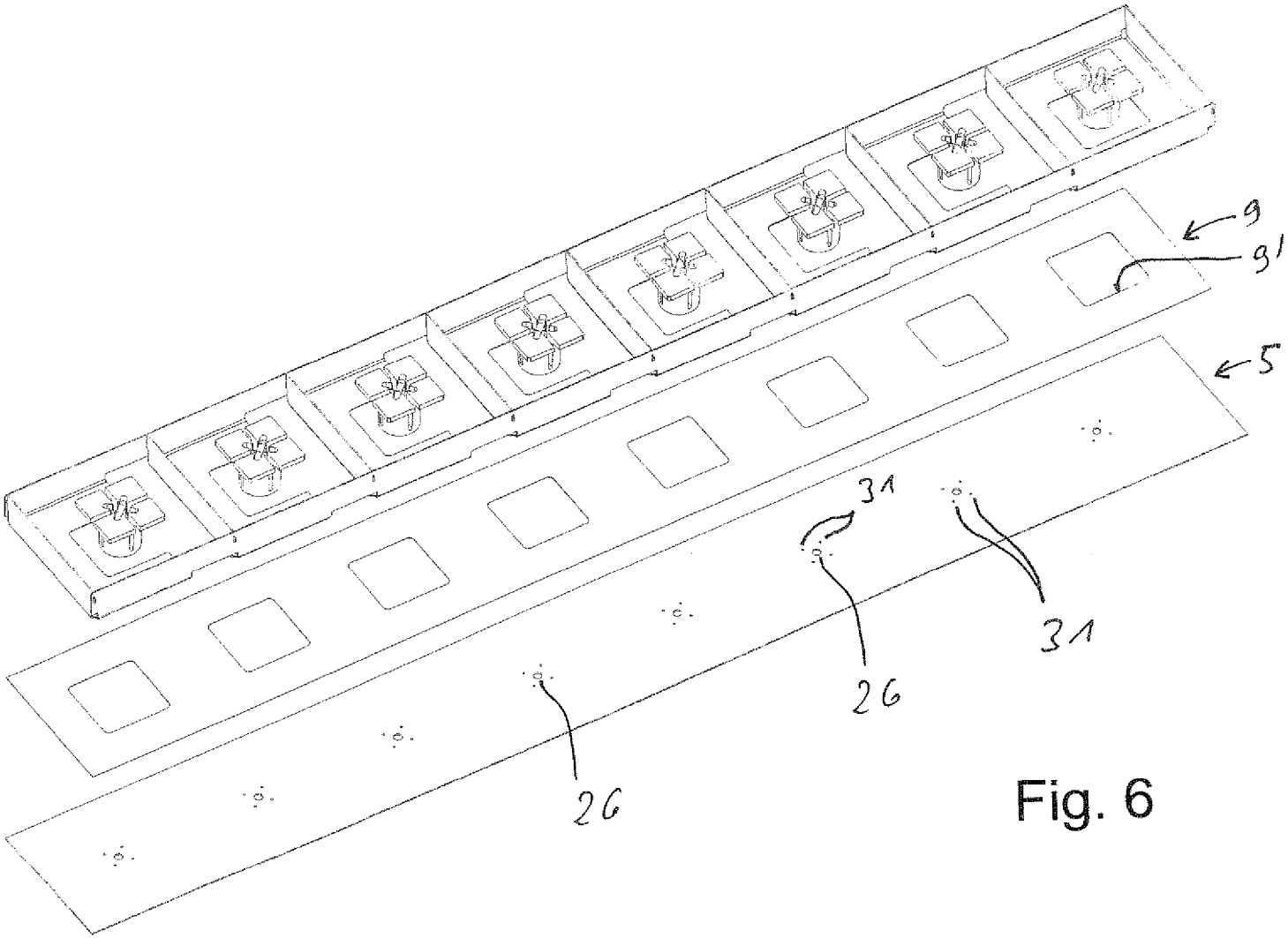
FIG. 6 shows an exploded view of the antenna arrangement for using the reflector frame described with reference to FIGS. 4 and 5.

With reference to FIGS. 4 to 6, a reflector frame for eight radiator assemblies or radiator groups is disclosed. By way of example, if the antenna arrangement and therefore the reflector frame are assembled in the vertical direction, two continuous longitudinal webs 15 may extend in the vertical direction. In the case of a total of eight reflector fields 25, this comprises nine transverse webs 17. With reference to FIGS. 4 to 6 it is also disclosed that this reflector frame 11 can be produced for example from a metal sheet, i.e. from a sheet material, by punching and canting or bending.

It can be seen from the plane developed view according to FIG. 5 that it is not just one recess 13*a* that has been punched from the material. Rather, as a result of transverse and lateral punched sections 27, the material of the transverse webs 17 is ultimately also punched out.

Following the effected punching process according to FIG. 5, the longitudinal and transverse webs located in one plane can preferably be inclined upwards by 90°. The transverse webs 17 along the canting lines 17*a* in each case are assembled at preferably 90° with respect to the plane of the coupling surfaces 13. The two longitudinal webs 15 are assembled along the canting lines 15*a* at 90°.

As may also be seen from FIGS. 4 to 6, the punching process is performed such that a respective tongue 17*c* that protrudes from the transverse web 17 and into its plane is formed on the lateral edges 17*b* of the transverse webs 17. A respective slotted recess 15*b* is punched out of the two lateral webs 15 at an appropriate position in the finally produced reflector frame. When the reflector frame is finally assembled, the tongues 17*c* of the transverse webs 17 engage in the slotted recesses 15*b* of the longitudinal webs 15, as can be seen from FIGS. 4 and 6. The transverse webs 17 are also securely mechanically held and fixed in position thereby.

Otherwise, the thus formed reflector frame 11 is positioned in the described manner, optionally with separate insertion of an insulating layer or film 9 on the ground plane 7, i.e. ultimately on the printed circuit board 5, and is suitably fixed thereto, as described preferably with insertion of a double-sided adhesive tape 9.

It is clear from the illustration that in this embodiment, the window-like recess 13*a* is not just square but, in contrast, is also larger. Once the transverse web 17 has been lifted up, a corresponding rectangular portion is removed from the coupling surface. This being the case, the recess 13*a* is T-shaped in this instance. Only in the illustration according to FIG. 5 is the recess still square at the top right-hand edge, as in this embodiment the transverse web 27 located furthest right is tilted up via a bending edge 17*a* located, from its perspective, on the. In other words, no additional portion of material is removed from the coupling surface region here.

In contrast to FIGS. 4 and 5, FIG. 6 indicates only as a variation that the lateral portions of the coupling surface 13 can have different widths, depending on how wide the reflector arrangement formed by the ground plane should be in total. Finally, it is noted that by way of example the transverse webs 17 do not have to be provided with lateral edges 17*b* running at a right angle to the bending edge 17*a*. Instead, the punch lines can also run obliquely here such that when assembled, the two longitudinally running webs are not oriented perpendicularly to the reflector plane but can be oriented so as to, for example, diverge (or converge) in the beam direction. For the sake of completeness, it is again emphasized that a respective recess 26 is provided in the printed circuit board in the centre of the radiator arrangement 3. Via this recess, for example from the back of the printed circuit board 5, a screw (in the case of capacitive coupling, a plastic screw) can be screwed into the base 21*a* of the supporting mechanism and/or balancing means 21 in order to mechanically fix the radiator arrangement 3. Four size-reduced holes 31 are also apparent, via which an internal conductor for feeding the dual-polarized radiator arrangement can ultimately be supplied.

Figure 7:
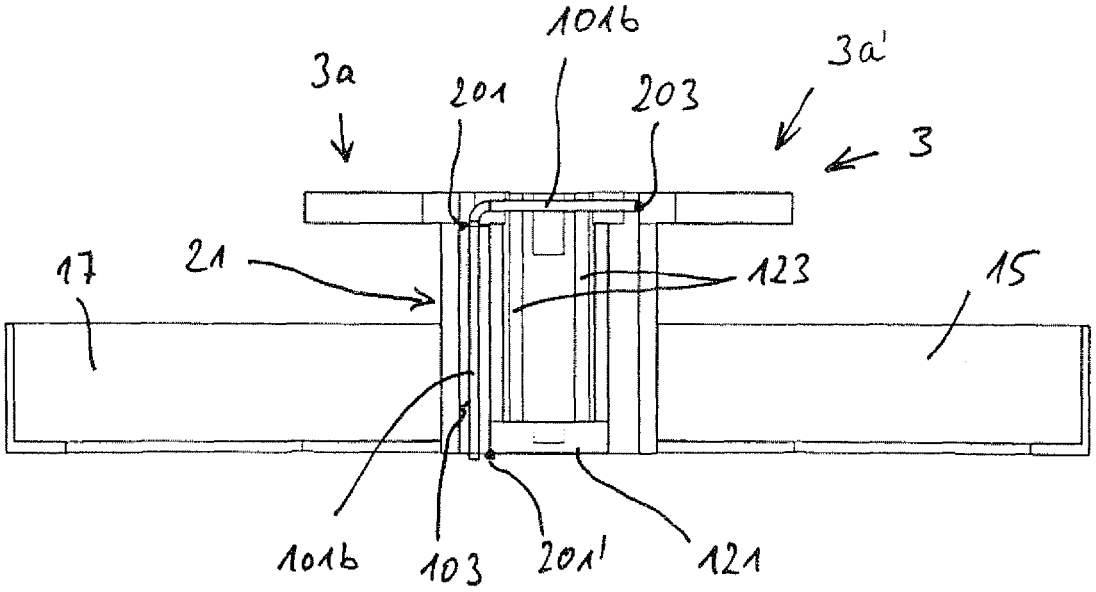
FIG. 7 shows a schematic cross-sectional view through a dual-polarized radiator with a portion of the reflector arrangement to illustrate feeding of the radiator.
Figure 8:
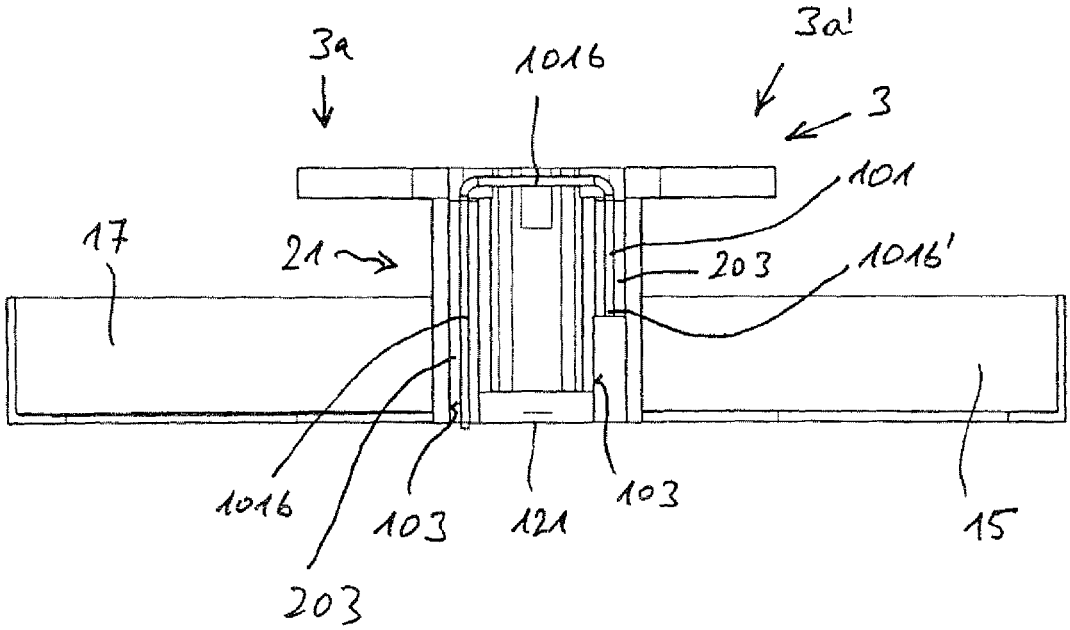
FIG. 8 shows an embodiment that has been modified with respect to FIG. 7.

FIGS. 7 and 8 only indicate in a schematic section through a corresponding radiator arrangement how a dual-polarized or, in a similar manner, a mono-polarized radiator 3 can be fed.

Feeding conventionally takes place by means of a coaxial cable which runs from the underside of the reflector through an axial hole 103 leading in the supporting mechanism or balancing means 21 to the plane of the actual dipole and/or radiator halves 3*a*. The coaxial cable is stripped at the upper end of this axial hole at the level of the dipole and/or radiator halves 3*a*. In this way, the external conductor, which is insulated in the axial hole 103 from the supporting mechanism and/or balancing means 21, is exposed. In the upper region, it is then electrically/galvanically connected for example by means of a soldering 201, to the inner end of an associated dipole or radiator half 3*a*. The drawings in FIG. 5 show substantially only the internal conductor 101*b*. The coaxial cable would therefore be laid from bottom to top through the axial hole 103. The external conductor, as mentioned, then is electrically-galvanically connected at the upper end of the supporting mechanism 21 to the associated dipole or radiator half 3*a* via the soldering 201. The external conductor is insulated from the supporting mechanism 21 up to this point.

Alternatively or preferably however, a coaxial feeder cable is connected in such a way that the external conductor is held at the lower end of the hole 103, for example at a soldering point 201'. The internal conductor 101*b* is held only by an insulator and is separately upwardly guided in the hole 103. The hole in the supporting mechanism therefore acts as an external conductor that surrounds the internal conductor 101*b* so a more or less coaxial feeder is formed hereby. The dipole and/or radiator halves, which as a rule are electrically-galvanically conductively connected to the supporting mechanism as a joint component, are fed by the coaxial feeder.

If one dipole half (which is not fed via the internal conductor) is not fed by an electrical-galvanic coupling, for example in the region of the hole in the supporting mechanism, but for example by soldering-on of an external conductor of a coaxial cable, appropriate feeding can also be brought about capacitively. This can be done for example by a capacitive coupling between the base of the supporting mechanism and the ground plane or reflector surface. Therefore the associated feeder, usually the external conductor of a coaxial cable, is conventionally connected in a region underneath the supporting mechanism. In plan view, this supporting mechanism is located perpendicularly to the reflector, preferably in the region underneath the dipole or radiator half that is fed thereby.

The internal conductor 101*b* which is conventionally connected to the internal conductor of a coaxial cable is usually bent substantially at the level of the dipole and/or radiator halves 3*a* by 90° or substantially 90°. The internal conductor leads to the adjacent inner end of the associated second dipole and/or radiator half 3*a* and is conventionally electrically connected there by means of soldering 203.

In the case of a dual-polarized radiator, feeding of the dipole and/or radiator halves 3*a* that are mutually offset by 90° takes place accordingly. The second internal conductor, running so as to cross the first internal conductor 101*b*, is arranged on a different plane so the two internal conductors do not touch in the middle but bypass each other.

In the case of a simply polarized radiator with just one polarization plane, only one feeder, which is also called an internal conductor, is required.

The embodiment according to FIG. 8 shows that the end 101*b'* of the internal conductor 101*b* ends freely in a further axial hole 103. This further axial hole 103 is provided in the supporting and/or balancing mechanism 21. In this case, the freely-ending end portion of the internal conductor 101*b* is guided downwards over a certain axial length in this further hole 103. It is held in the hole 103 by an insulator 203 (similar to the corresponding insulator 203 for fixing the internal conductor 101*b* in the other axial hole 103), whereby a capacitive or serial coupling is effected here with respect to the second dipole and/or radiator half 3*a'*.

Other types of feeding are also possible.

It is mentioned purely for the sake of completeness that it may also be seen from FIGS. 7 and 8 for example that in this case the slots 123 extend up to the lower plane or base 121 of the supporting and/or balancing mechanism 21. The height of this supporting and/or balancing mechanism 21 or the slots 123 should preferably be in a range from about ⅛ to ⅜ of a wavelength from the relevant operating frequency band that is to be transmitted or received. The height should therefore preferably be ⅛ to ⅜, based on the mean wavelength λ of the frequency band that is to be transmitted or received, i.e. preferably at about ¼λ. In general the radiator height with respect to the reflector, i.e. with respect to the ground plane or reflector surface, should therefore not fall below a value of λ/10, wherein, in principle, there is no upper limit, so the radiator height could even be any multiple of λ. The length of the slots 123 can then be adjusted accordingly.

The invention claimed is:

1. An antenna arrangement, comprising:

at least one radiator assembly comprising a vector dipole array;

a supporting structure disposed beneath the vector dipole array, supporting and configured for feeding RF energy to the vector dipole array, a reflector arrangement comprising an electrically conductive reflector surface, and at least one electrically conductive longitudinal or transverse web, the reflector arrangement further comprising a printed circuit board, an electrically conductive ground plane structure being disposed on said printed circuit board, the reflector arrangement further comprising a reflector frame comprising a coupling surface that runs parallel to the printed circuit board ground plane structure, the coupling surface being capacitively coupled to the ground plane structure and mechanically and electrically-galvanically connected to the at least one longitudinal or transverse web;

the coupling surface defining therein a window through which the printed circuit board ground plane structure is exposed to the vector dipole array to thereby capactively couple, through the window, the printed circuit board ground plane structure with the vector dipole array, the supporting structure holding and supporting the at least one vector dipole array radiator assembly above the printed circuit board in the region of the window.

2. The antenna arrangement as claimed in claim 1, wherein the reflector frame comprises at least two longitudinal or transverse webs.

3. The antenna arrangement as claimed in claim 1, wherein the at least one longitudinal or transverse web is constructed with the coupling surface as a one-piece metal part.

4. The antenna arrangement as claimed in claim 3, wherein the at least one longitudinal or transverse web is bent on a bending line with respect to the coupling surface in a different angular direction with respect to the coupling surface.

5. The antenna arrangement as claimed in claim 1, wherein the reflector frame is at least one of cast, deep-drawn, punched or milled.

6. The antenna arrangement as claimed in claim 1, wherein the reflector arrangement or reflector frame comprises an insulating material material covered with an electrically conductive layer.

7. The antenna arrangement as claimed in claim 1, wherein the reflector frame is mechanically connected to the printed circuit board.

8. The antenna arrangement as claimed in claim 7, further including at least one of a clip, a latching mechanism and a snap-fit mechanism that securely connects the reflector frame to the printed circuit board.

9. The antenna arrangement as claimed in claim 1, wherein the reflector frame is glued to the printed circuit board.

10. The antenna arrangement as claimed in claim 1, further including a double-sided adhesive film or tape that securely connects the reflector frame to the printed circuit board.

11. The antenna arrangement as claimed in claim 10, wherein the adhesive tape or film define a recess, having a size or position that matches at least the size or position of the window, or is smaller than the size or position of the window.

12. The antenna arrangement as claimed in claim 10, wherein the adhesive tape or film is provided between the underside of the coupling surface and the ground plane structure in the region of the window in the coupling surface.

13. The antenna arrangement as claimed in claim 12, wherein the adhesive tape or film is provided on the printed circuit board between an underside of the coupling surface and the ground plane structure in the region between the base of the supporting structure of the radiator assembly and the ground plane structure.

14. The antenna arrangement as claimed in claim 1, wherein the radiator assembly is capacitively coupled by an associated base of the supporting structure to the printed circuit board ground plane structure.

15. The antenna arrangement as claimed in claim 1, wherein the radiator assembly is galvanically, connected to the printed circuit board ground plane structure.

16. The antenna arrangement as claimed in claim 15, wherein the radiator assembly is galvanically connected by its base of the supporting structure to the printed circuit board ground plane structure.

17. The antenna arrangement as claimed in claim 1, wherein the reflector frame is produced from a metal sheet by punching and canting or bending.

18. The antenna arrangement as claimed in claim 17, wherein the transverse webs are punched from a common sheet metal part and are securely connected to the coupling surface via a respectively associated bending line.

19. The antenna arrangement as claimed in claim 17, wherein the longitudinal webs or transverse web is connected to the coupling surface via a bending line.

20. The antenna arrangement as claimed in claim 17, wherein the reflector arrangement further comprises longitudinal and transverse webs wherein at their lateral limiting edges the transverse webs are provided with tongues that laterally protrude in the plane of the lateral edges and which in the assembled state project into recesses in the longitudinal webs with the orientation of the transverse webs pointing away from the reflector surface.

21. The antenna arrangement as claimed in claim 20, wherein in the assembled state the tongues project into slotted recesses in the longitudinal webs.

22. The antenna arrangement as claimed in claim 1, further including plural radiator devices each of which is arranged with a respective window in a coupling surface.

23. The antenna arrangement as claimed in claim 1, wherein the supporting structure of the dipole array comprises a balancing structure.

24. The antenna arrangement as claimed in claim 1, wherein the at least one radiator assembly consists of a dual-polarized dipole array.

25. A mobile antenna comprising:

a printed circuit board having a surface providing an electrically conductive ground plane structure;

an electrically conductive reflector frame comprising a coupling surface disposed parallel to the electrically conductive ground plane structure and further comprising at least one protruding wall portion, the reflector frame comprising a coupling surface capacitively coupled to and electrically isolated from the conductive ground plane structure, the coupling surface being mechanically and electrically connected to the at least one protruding wall portion, the coupling surface defining a window therethrough through which the printed circuit board ground plane structure is capacitively coupled to at least one radiator assembly thereabove, the at least one radiator assembly comprising a vector dipole array; and a support structure disposed within the window between the vector dipole array and the printed circuit board, the support structure feeding the vector dipole array and positioning and supporting the vector dipole array on the printed circuit board in the region of the window.

26. The mobile antenna of claim 25 wherein the ground plane structure comprises a conductive sheet having an insulating layer thereon, the insulating layer facing the window.

27. The mobile antenna of claim 25 wherein the printed circuit board ground plane structure comprises a conductive sheet at least partially covered with an insulating layer, the window exposing the insulating layer so that the conductive sheet is capacitively coupled to the radiator assembly through the insulating layer and the window.

28. The antenna arrangement of claim 1 wherein the printed circuit board ground plane structure comprises a conductive sheet at least partially covered by an insulating layer which faces the window, the window exposing the insulating layer to capacitively couple the conductive sheet to the radiator assembly through the insulating layer and the window.

* * * * *